US009834941B1

(12) United States Patent
Bilge

(10) Patent No.: US 9,834,941 B1
(45) Date of Patent: Dec. 5, 2017

(54) THERMAL BREAK SYSTEM FOR WALL PANELS SECURED TO AN EXISTING WALL

(71) Applicant: Henry H. Bilge, Fort Lee, NJ (US)

(72) Inventor: Henry H. Bilge, Fort Lee, NJ (US)

( * ) Notice: Subject to any disclaimer, the term of this patent is extended or adjusted under 35 U.S.C. 154(b) by 0 days.

(21) Appl. No.: 15/047,204

(22) Filed: Feb. 18, 2016

(51) Int. Cl.

| | |
|---|---|
| ***E04F 13/00*** | (2006.01) |
| ***E04F 13/24*** | (2006.01) |
| ***E04F 17/04*** | (2006.01) |
| ***E04B 2/02*** | (2006.01) |
| ***E04B 1/38*** | (2006.01) |
| ***E04B 1/76*** | (2006.01) |

(52) U.S. Cl.
CPC ..... *E04F 13/24* (2013.01); *E04B 1/38* (2013.01); *E04B 1/76* (2013.01); *E04B 2/02* (2013.01); *E04F 17/04* (2013.01); *E04B 2002/0202* (2013.01)

(58) Field of Classification Search
CPC ..... E04B 1/38; E04B 1/76; E04B 2/02; E04B 2/28; E04B 2/30; E04B 2002/0202; E04B 2002/025; E04B 2002/028; E04B 2002/0282; E04F 13/24; E04F 17/04
See application file for complete search history.

(56) References Cited

U.S. PATENT DOCUMENTS 8,240,099 B2 * 8/2012 Hummel, III ..... E04F 13/081 52/235
8,429,866 B2 4/2013 Knight et al.
8,468,765 B1 * 6/2013 Kim ..... E04F 13/0835 52/235
8,850,767 B2 * 10/2014 Rutherford ..... E04B 1/64 52/364
8,875,467 B2 11/2014 Anastasi
9,163,411 B2 10/2015 Brady
2005/0060950 A1 * 3/2005 Hauschildt ..... E04F 13/0814 52/235
2007/0022682 A1 * 2/2007 Morgenegg ..... E04F 13/0889 52/235

FOREIGN PATENT DOCUMENTS

WO 2011044696 A1 4/2011

* cited by examiner

*Primary Examiner* — Patrick J Maestri
(74) *Attorney, Agent, or Firm* — Richard M. Goldberg

(57) ABSTRACT

A thermal break system for securing wall panels to an existing wall includes a furring member connected between the existing wall and the wall panels, the furring member including at two foot walls adapted to be connected to the existing wall, at least one spacing wall having one end connected to the foot walls and extending in a direction transverse to the at least one foot wall and the existing wall, and a connection wall connected to an opposite end of the at least one spacing wall and extending in a direction transverse to the at least one spacing wall for connection either directly to adjacent wall panels or indirectly to adjacent wall panels through at least one intermediary member; and a thermal insulation cover positioned at least between the at least one foot wall and the existing wall.

4 Claims, 9 Drawing Sheets

THERMAL BREAK SYSTEM FOR WALL PANELS SECURED TO AN EXISTING WALL

BACKGROUND OF THE INVENTION

The present invention relates generally to a wall system, and more particularly, a system for mounting wall panels to an existing wall with Z-, U-channel or T-furring with thermal breaks to provide a thermal break system for the wall panels secured to the existing wall.

When installing wall panels over an existing wall, it is often necessary to provide a spacing between the wall panels and the existing wall. This spacing can be provided for ventilation, to provide for water run-off, to provide insulation therein, and to provide a thermal barrier. Typically, Z-furring or U-channel furring is used to provide this spacing between the existing wall and the wall panels.

However, it has been found that this arrangement is not entirely satisfactory.

For example, although it is known to combine insulation with the Z-furring or U-channel furring, such insulation is not securely held therein, and must be secured by screws, adhesive or the like. Further, the outwardly extending foot walls of the Z-furring or U-channel furring are secured directly to the existing wall, thereby providing thermal transfer directly with the existing wall. In addition, such Z-furring or U-channel furring may not be entirely satisfactory in providing thermal insulation, and in many cases, it is desirable to increase the thermal insulation. It is also not possible to change the spacing between the walls panels and existing wall since the Z-furring or U-channel furring are of fixed dimensions.

SUMMARY OF THE INVENTION

Accordingly, it is an object of the present invention to provide a thermal break system for wall panels secured to an existing wall that overcomes the aforementioned problems.

It is another object of the present invention to provide a thermal break system for wall panels secured to an existing wall that creates a spacing between the wall panels and the existing wall to enable ventilation, to provide for water run-off, to provide insulation therein, and to provide a thermal barrier.

It is still another object of the present invention to provide a thermal break system for wall panels secured to an existing wall that, in addition to Z-furring or U-channel furring, provides additional thermal insulation between the existing wall and the outside.

It is yet another object of the present invention to provide a thermal break system for wall panels secured to an existing wall in which one form of the additional thermal insulation is created by thermal insulation covers for the foot walls of the Z-furring or U-channel furring.

It is a further object of the present invention to provide a thermal break system for wall panels secured to an existing wall in which another form of the additional thermal insulation is created by thermal break attachments connected between the main fastening extrusion for the wall panels and the Z-furring or U-channel furring.

It is a still further object of the present invention to provide a thermal break system for wall panels secured to an existing wall in which the thermal break attachments are formed by parallel, spaced apart and connected walls.

It is a yet further object of the present invention to provide a thermal break system for wall panels secured to an existing wall in which the thermal break attachments have attachments to easily secure to the Z-furring or U-channel furring.

It is another object of the present invention to provide a thermal break system for wall panels secured to an existing wall in which insulation is tightly held in the spacing between the extension walls of the Z-furring, U-channel furring or T-furring and outwardly extending foot walls of the Z-furring, U-channel furring or T-furring and between the common transverse wall and the inwardly extending foot walls of the Z-furring, U-channel furring or T-furring, without the need for any screws, adhesive or the like.

It is still another object of the present invention to provide a thermal break system for wall panels secured to an existing wall in which the height of the Z-furring or U-channel furring can be varied to change the spacing between the wall panels and the existing wall in order to provide different thicknesses of insulation, vary the amount of ventilation, vary the amount of water run-off, and vary the thermal barrier.

In accordance with an aspect of the present invention, a thermal break system for securing wall panels to an existing wall is provided, in order to mount the wall panels in covering relation to the existing wall, the thermal break system comprising a furring member connected between the existing wall and the wall panels, the furring member including at least one foot wall adapted to be connected to the existing wall, at least one spacing wall having one end connected to the at least one foot wall and extending in a direction transverse to the at least one foot wall and the existing wall, and a connection wall connected to an opposite end of the at least one spacing wall and extending in a direction transverse to the at least one spacing wall for connection either directly to adjacent wall panels or indirectly to adjacent wall panels through at least one intermediary member; and a thermal insulation cover positioned at least between the at least one foot wall and the existing wall.

The thermal insulation cover wraps at least partially around the at least one foot wall.

Preferably, the at least one foot wall includes a first foot wall extending to one side of the at least one spacing wall and a second foot wall extending to an opposite side of the at least one spacing wall, and the thermal insulation cover wraps at least partially around both the first and second foot walls.

The thermal insulation cover includes a first section interposed between the at least one foot wall and the existing wall, and a second section positioned above the at least one foot wall, with aligned openings provided in the first and second sections and the at least one foot wall for receiving screws to secure the at least one foot wall to the existing wall, and wherein the openings in the at least one foot wall have a diameter greater than a diameter of the screws so as to be out of contact with the screws.

The furring member has a U-shape, a Z-shape, or a T-shape.

In accordance with another aspect of the present invention, a thermal break system for securing wall panels to an existing wall is provided, in order to mount the wall panels in covering relation to the existing wall, the thermal break system comprising a furring member connected between the existing wall and the wall panels, the furring member including first and second foot walls, at least one of the foot walls adapted to be connected to the existing wall, at least one spacing wall having one end connected to the first and second foot walls and extending in a direction transverse to the first and second foot walls and the existing wall, with the first foot wall extending to one side of the at least one spacing wall and the second foot wall extending to an opposite side of the at least one spacing wall, and a connection wall connected to an opposite end of the at least one spacing wall and extending in a direction transverse to the at least one spacing wall for connection either directly to adjacent wall panels, or indirectly to adjacent wall panels through at least one intermediary member, wherein the connection wall includes a first section extending to the one side of the at least one at least one spacing wall and a second section extending to the opposite side of the at least one spacing wall, so as to hold one end of insulation between the first foot wall and the first section of the connection wall and to hold one end of insulation between the second foot wall and the second section of the connection wall.

The second foot wall can be removably connected to the at least one spacing wall.

In accordance with still another aspect of the present invention, a thermal break system for securing wall panels to an existing wall is provided, in order to mount the wall panels in covering relation to the existing wall, the thermal break system comprising a furring member connected between the existing wall and the wall panels, the furring member including at least one foot wall adapted to be connected to the existing wall, at least one spacing wall having one end connected to the at least one foot wall and extending in a direction transverse to the at least one foot wall and the existing wall, and a connection wall connected to an opposite end of the at least one spacing wall and extending in a direction transverse to the at least one spacing wall for connection either directly to adjacent wall panels, or indirectly to adjacent wall panels through at least one intermediary member, wherein the connection wall includes a first section extending to one side of the at least one at least one spacing wall and a second section extending to an opposite side of the at least one spacing wall.

The thermal break system further includes a thermal break attachment connected to the connection wall, the thermal break attachment including spaced apart walls to provide a further thermal break between the existing wall and the wall panels; and a fastening extrusion secured to the thermal break attachment for securing the wall panels to the thermal break attachment. The thermal break attachment includes an attachment arrangement for connecting to the connection wall, which includes either hook walls for enclosing edges of the connection wall; or a dovetail connecting arrangement in the thermal break attachment and the connection wall.

In accordance with yet another aspect of the present invention, a thermal break system for securing wall panels to an existing wall is provided, in order to mount the wall panels in covering relation to the existing wall, the thermal break system comprising a furring member connected between the existing wall and the wall panels, the furring member including at least one foot wall adapted to be connected to the existing wall, at least one spacing wall having one end connected to the at least one foot wall and extending in a direction transverse to the at least one foot wall and the existing wall, and a connection wall connected to an opposite end of the at least one spacing wall and extending in a direction transverse to the at least one spacing wall for connection either directly to adjacent wall panels, or indirectly to adjacent wall panels through at least one intermediary member, wherein the at least one spacing wall includes a first wall section connected with the at least one foot wall and a second wall section connected with the connection wall, with free ends of the first and second wall sections being spaced apart from each other; and a capture wall connected between the free ends of the first and second wall sections to increase a height of the at least one spacing wall.

The furring member includes a capture arrangement for securing opposite ends of the capture wall to the free ends of the first and second wall sections. The capture arrangement includes an L-shaped wall section secured to the first and second wall sections so as to create a capture space with the first and second wall sections for receiving respective ends of the capture wall; and a recess in either each end of the capture wall or the first and second wall sections in the capture space; and a detent in the other of either each end of the capture wall and the first and second wall sections in the capture space.

In accordance with a further aspect of the present invention, a thermal break system for securing wall panels to an existing wall is provided, in order to mount the wall panels in covering relation to the existing wall, the thermal break system comprising a furring member connected between the existing wall and the wall panels, the furring member including first and second foot walls, at least one of the foot walls adapted to be connected to the existing wall, at least one spacing wall having one end connected to the first and second foot walls and extending in a direction transverse to the first and second foot walls and the existing wall, with the first foot wall extending to one side of the at least one spacing wall and the second foot wall extending to an opposite side of the at least one spacing wall, and a connection wall connected to an opposite end of the at least one spacing wall and extending in a direction transverse to the at least one spacing wall for connection either directly to adjacent wall panels, or indirectly to adjacent wall panels through at least one intermediary member, wherein the connection wall includes a first section extending to the one side of the at least one at least one spacing wall and a second section extending to the opposite side of the at least one spacing wall, so as to hold one end of insulation between the first foot wall and the first section of the connection wall and to hold one end of insulation between the second foot wall and the second section of the connection wall; a thermal insulation cover positioned at least between the at least one foot wall and the existing wall; a thermal break attachment connected to the connection wall, the thermal break attachment including spaced apart walls to provide a further thermal break between the existing wall and the wall panels; a fastening extrusion secured to the thermal break attachment for securing the wall panels to the thermal break attachment; wherein the at least one spacing wall includes a first wall section connected with the at least one foot wall and a second wall section connected with the connection wall, with free ends of the first and second wall sections being spaced apart from each other; and a capture wall connected between the free ends of the first and second wall sections to increase a height of the at least one spacing wall.

In accordance with a still further aspect of the present invention, a thermal break system for securing wall panels to an existing wall is provided, in order to mount the wall panels in covering relation to the existing wall, the thermal break system comprising wall panels, each including a main panel section, and at least two bent end sections extending at right angles to and at edges of the main panel section, each bent end section including an opening therein; and a furring member connected between the existing wall and the wall panels, the furring member including at least one foot wall adapted to be connected to the existing wall, a spacing wall having one end connected to the at least one foot wall and extending in a direction transverse to the at least one foot wall and the existing wall, and a connection wall connected to an opposite end of the at least one spacing wall and extending in a direction transverse to the at least one spacing wall for engagement in the openings of the bent end sections of adjacent wall panels.

There is further a thermal break wall member connected to an outer surface of the connection wall in a space between the bent end sections of the adjacent wall panels.

The above and other features of the invention will become readily apparent from the following detailed description thereof which is to be read in connection with the accompanying drawings.

DETAILED DESCRIPTION

Figure 1:
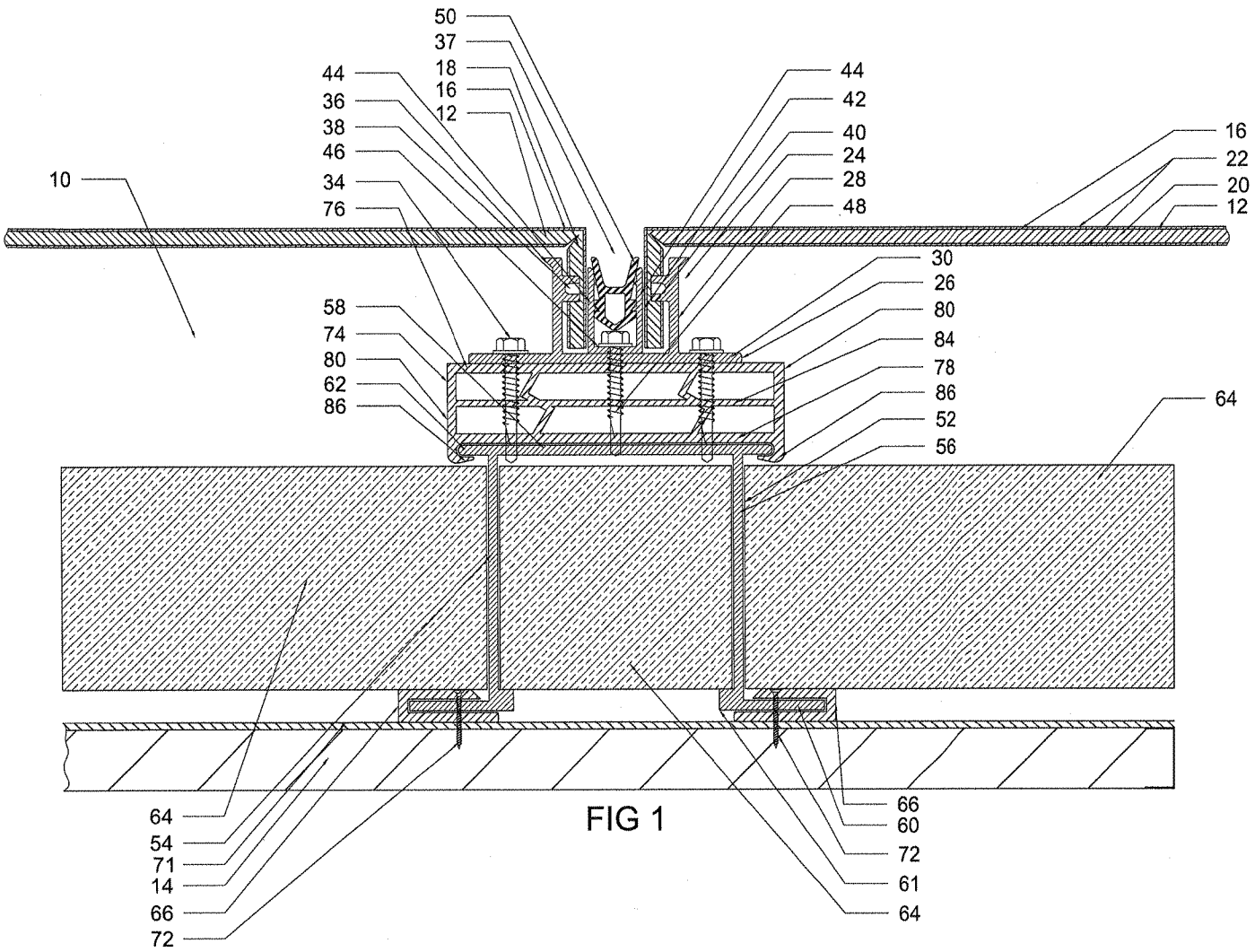
FIG. 1 is a cross-sectional view of a thermal break system for wall panels secured to an existing wall according to a first embodiment of the present invention.

Referring to the drawings in detail, and initially to FIGS. 1-4 thereof, there is shown a system 10 according to the present invention for mounting wall panels 12 over an existing planar wall 14 through U-channel furring with thermal breaks.

Each wall panel 12 preferably includes a rectangular shaped, planar main panel section 16 and at least two bent end sections 18 bent at a right angle in the same direction at edges of main panel section 16. Main panel section 16, however, need not be planar, and in fact, can have different shapes, such as a wave shape, etc. to provide different aesthetic appearances. Preferably, there are four bent end sections 18 at each edge of main panel section 16 which form an L-shaped cross sectional shape thereat. However, the invention is not limited thereby and wall panels 12 can be formed with two, three or more bent end sections 18, or alternatively, bent end sections 18 can be eliminated entirely. Wall panels 12 are formed preferably by, but not limited to, a polyethylene core 20 with an aluminum wall 22 covering opposite sides thereof, as shown in FIG. 1.

As shown in FIG. 1, main fastening extrusions 24 are provided for securing each primary wall panel 12 to existing wall structure 14. Each main fastening extrusion 24 is preferably formed as a single, one-piece, unitary member that includes a base section 26 to be secured to existing wall 14 via intermediary members to be described hereafter, and a supporting section 28 to which bent end sections 18 of wall panels 12 are secured. As with each wall panel 12, each main fastening extrusion 24 is formed preferably by, but not limited to, a polyethylene core with a thin aluminum wall covering opposite sides thereof. Alternatively, each main fastening extrusion 24 can be formed from polyvinyl chloride (PVC), aluminum or any other suitable material. It will be appreciated that base section 26 can be formed from a plurality of pieces as well.

Base section 26 includes a central planar wall 30 that seats flush against and is secured to an intermediary structure (to be described hereafter) that is secured to existing wall 14, and which has a plurality of linearly aligned openings (not shown) extending therealong and through which screws 34 can be inserted to secure central planar wall 30 to the intermediary member which is described hereinafter.

Supporting section 28 includes two, parallel, spaced apart, bent end securing walls 36 extending outwardly at right angles from central planar wall 30 and extending the length of each main fastening extrusion 24. The space 37 between bent end securing walls 36 is much greater than the thickness of two bent end sections 18.

Each bent end securing wall 36 includes a projection 38 at the surface thereof in facing relation to the adjacent bent end securing wall 36, with each projection 38 having a generally rectangular parallelepiped shape, which corresponds in shape and dimensions to a rectangular parallelepiped cut-out recess 40 in each bent end section 18, although the present invention is not limited thereby. Projections 38 preferably extend along the entire length of the respective bent end securing wall 36, although the present invention is not so limited, that is, projections 38 can extend along only a part of the length of the respective bent end securing wall 36, or there may be a plurality of spaced apart projections 38.

To assemble wall panels 12 with main fastening extrusions 24, it is only necessary to insert bent end sections 18 into the space 37 between bent end securing walls 36, as shown in FIG. 1, such that projections 38 enter into recesses 40. Thereafter, a U-shaped channel member 42 having two, parallel, spaced apart plates 44 connected together by a connecting plate 46, is inserted into the space 37 between the two bent end sections 18 therein, so as to prevent removal of bent end sections 18. Screws 48 are inserted through openings (not shown) in connecting plate 46 and into the intermediary members to lock U-shaped channel member 42 in space 37. A resilient plug 50 of rubber or similar material is then inserted into U-shaped channel member 42 in covering relation to screws 48.

It will be appreciated that the present invention is not limited to this particular arrangement for securing wall panels 12 to main fastening extrusions 24. Thus, any arrangement disclosed in the applicant's other patent properties can be used, for example, those arrangements disclosed in any of U.S. Pat. Nos. 7,472,521; 7,621,084; 8,127,507; 8,833,015; 8,739,483; 8,925,271; and 8,966,849 and pending U.S. patent application Ser. Nos. 14/044,606; 14/256,384; 14/641,097; 14/667,297; and Ser. No. 14/694,241, the entire disclosures of which are incorporated herein by reference.

In order to provide a spacing 51 between the wall panels 12 and the existing wall 14, for example, for ventilation, to provide for water run-off, to provide insulation therein, and to provide a thermal barrier, a U-channel furring 52 is connected between existing wall 14 and wall panels 12.

Specifically, U-channel furring 52 includes two parallel, spaced apart spacing walls 54 and 56 connected together by a common transverse connection wall 58 at one end of walls 54 and 56, as is known. Also, outwardly extending foot walls 60 are connected to the opposite free ends of spaced apart walls 54 and 56, as is also known. However, in accordance with one aspect of the present invention, opposing inwardly extending foot walls 61 extend inwardly of walls 54 and 56 in a coplanar arrangement with outwardly extending foot walls 60, and opposite extension walls 62 are formed as a continuation of common transverse wall 58 and extend outwardly of spaced apart walls 54 and 56. In this manner, insulation 64 positioned in spacing 51 is tightly held between foot walls 60 and extension walls 62 so as to prevent escape thereof, and to keep insulation 64 properly positioned at all times. Further, insulation 64 is tightly held between common transverse wall 58 and inwardly extending foot walls 61. This eliminates the need for any additional members to hold the insulation 64 in place, such as screws, adhesives, etc., while also eliminating any extra labor that would result therefrom.

Figure 1A:
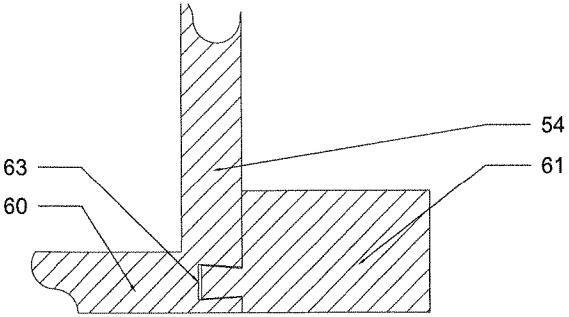
FIG. 1A is a cross-sectional view of a modification of the attachment of the inwardly extending foot walls of FIG. 1.
Figure 3:
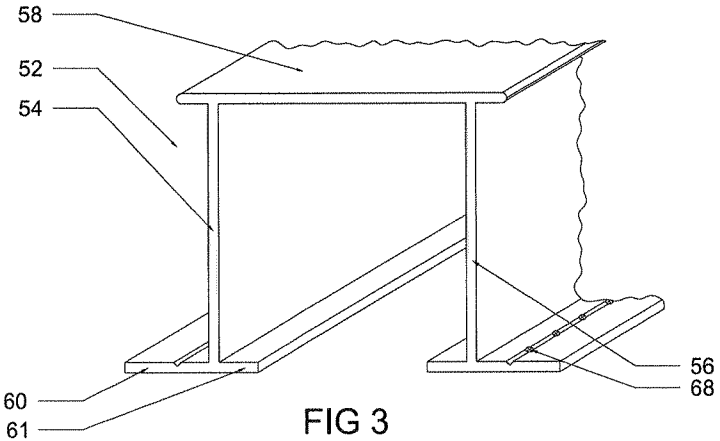
FIG. 3 is perspective view of the U-shaped channel member thereof.

Further, as shown in FIG. 1A, inwardly extending foot walls 61 can be formed as separate elements from spaced apart walls 54 and 56, and can be removably connected thereto by a sliding dovetail connection 63.

It will be appreciated that U-channel furring 52 is made of a metal material, and therefore, is thermally conductive, that is, will transfer heat and cold from the outside to existing wall 14, which is undesirable. Therefore, in accordance with another aspect of the present invention, a generally J-shaped thermal insulation cover 66 is positioned around each foot wall 60, and is made of a thermally insulating material so that foot walls 60 are not in direct contact with existing wall 14 of the building. Any suitable thermally insulating material can be used, for example, ethylene propylene diene monomer (EPDM), neoprene, polyisoprene, natural rubber, synthetic rubber sold under the trademark VITON, nitrile rubber, silicone, plastics or the like.

It will be appreciated that, with the arrangement above, a space is further provided between insulation 64 and existing wall 14, which allows for water and air circulation. In this regard, a thin waterproof membrane 71 can be provided against existing wall 14.

Figure 2:
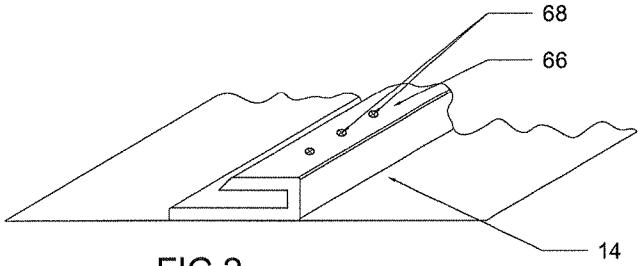
FIG. 2 is a perspective view of a J-shaped thermal insulation cover for a foot wall of the U-shaped channel member.
Figure 4:
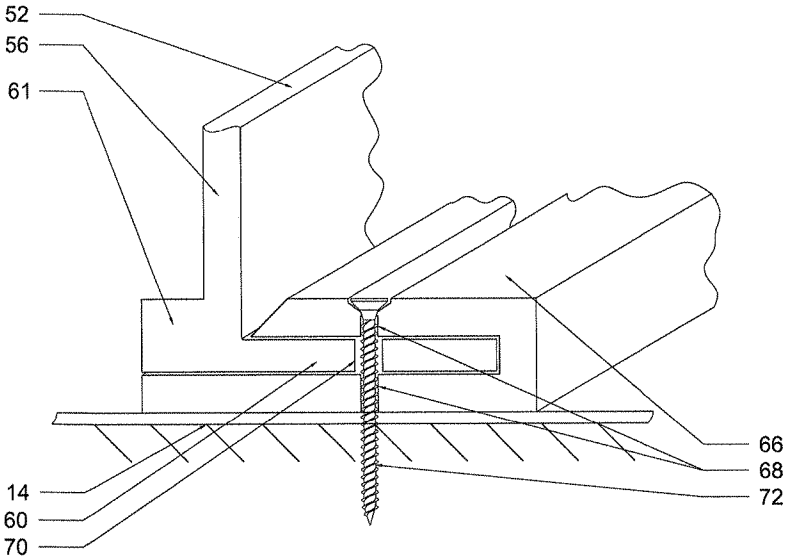
FIG. 4 is a perspective view showing the attachment of a foot wall with a J-shaped thermal insulation cover secured to the existing wall.

As shown in FIGS. 2 and 4, screw holes 68 are provided along upper and lower plates of J-shaped thermal insulation cover 66, and correspondingly aligned screw holes 70 are provided in foot walls 60, in order to receive screws 72 to secure foot walls 60 to existing wall 14. However, in accordance with the present invention, the diameter of screw holes 70 is much greater than the diameter of screws 72 so that screws 72 are not in contact with foot walls 60, and therefore, do not provide any thermal conduction to existing wall 14.

In addition, in accordance with the present invention, a further thermal break attachment 74 is connected between common transverse wall 58 of U-channel furring 52 and each main fastening extrusion 24. U-shaped channel member 42, J-shaped thermal insulation covers 66 and thermal break attachment 74 together form the aforementioned intermediary members which connect base section 26 of main fastening extrusion 24 to existing wall 14.

Thermal break attachment 74 is formed by at least an outer wall 76 and a parallel, spaced apart inner wall 78 connected together by outer transverse walls 80 and preferably, also by inner transverse walls 82. As shown in FIG. 1, thermal break attachment 74 also includes an intermediate wall 84 in parallel spaced apart relation to and between outer wall 76 and inner wall 78, and also connected with transverse walls 80 and 82.

L-shaped hook walls 86 extend inwardly from each of opposite ends of inner wall 78 for capturing opposite extension walls 62 in order to secure thermal break attachment 74 to U-channel furring 52, with common transverse wall 58 thereof held against the inner facing surface of inner wall 78 of thermal break attachment 74.

With this arrangement, central planar wall 30 of base section 26 of main fastening extrusion 24 is secured by screws 34 and 48 to the outer surface of outer wall 76 of thermal break attachment 74, with screws 34 and 48 preferably extending through intermediate wall 84, inner wall 78 and central planar wall 30.

By reason of the spaced apart outer wall 76, intermediate wall 84 and inner wall 78, air spaces are provided therebetween, thereby increasing the thermal insulation between wall panels 12 and existing wall 14.

It will be appreciated that the present invention, as described above, provides various advantages over the prior art. Specifically:

a) a spacing 51 is provided between the wall panels 12 and the existing wall 14 by means of U-channel furring 52 and thermal break attachment 74, to enable ventilation, to provide for water run-off, to provide insulation therein, and to provide a thermal barrier;

b) insulation 64 is tightly held in spacing 51 between extension walls 62 and outwardly extending foot walls 60 with or without J-shaped thermal insulation covers 66, and between common transverse wall 58 and inwardly extending foot walls 61, without the need for any screws, adhesive or the like;

c) because of extension walls 62, outwardly extending foot walls 60 and inwardly extending foot walls 61, the height or thickness of insulation 64 remains the same so that different heights of insulation 64 need not be used;

d) the use of thermal break attachment 74 with different spaced apart walls 76, 80 and 84 provides further thermal insulation;

e) the use of thermal break attachment 74 with L-shaped hook walls 86 enables easy connection between U-shaped channel members 42 and main fastening extrusions 24; and f) J-shaped thermal insulation covers 66 provide further thermal insulation between wall panels 12 and existing wall 14.

Figure 5:
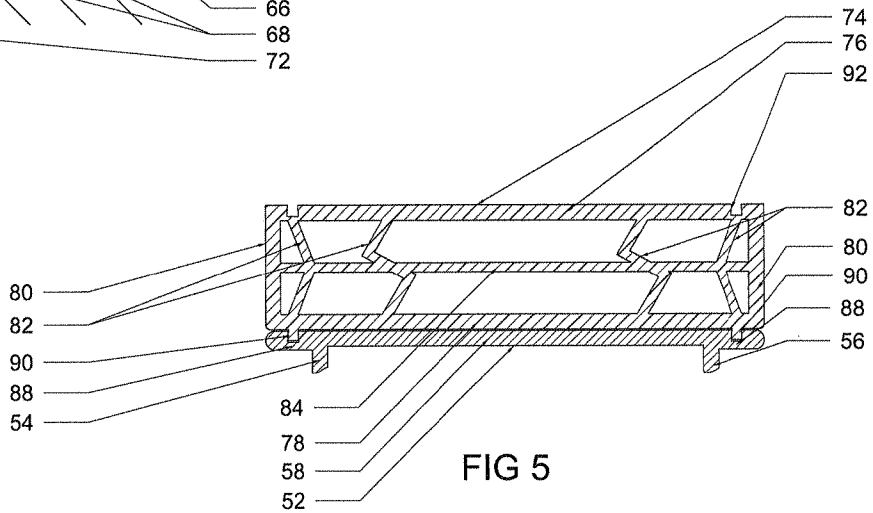
FIG. 5 is a cross-sectional view of a thermal break system for wall panels secured to an existing wall according to a first modification of the first embodiment of the present invention.

It will be appreciated that, although L-shaped hook walls 86 have been shown to capture opposite extension walls 62 of U-channel furring 52, any other suitable arrangement can be provided. For example, as shown in FIG. 5, L-shaped hook walls 86 are eliminated, and in place thereof, the upper surface of common transverse wall 58 of U-channel furring 52 includes parallel, spaced apart openings 88 having a dovetail cross-sectional configuration, and the lower surface of inner wall 78 of thermal break attachment 74 is provided with projections 90 having a dovetail cross-sectional configuration complementary in shape and dimensions to openings 88 to slidably lock therein.

In like manner, the upper surface of outer wall 76 of thermal break attachment 74 is provided with parallel, spaced apart openings 92 having a dovetail cross-sectional configuration, and in such case, the lower surface of central planar wall 30 of main fastening extrusion 24 can be provided with projections (not shown) having a dovetail cross-sectional configuration complementary in shape and dimensions to openings 92 to slidably lock therein. In such case, screws 34 and 48 can additionally be provided, or can even be eliminated. Further, one or more additional thermal break attachments 74 can be mounted one on top of the other, to increase the thermal insulation.

Figure 6:
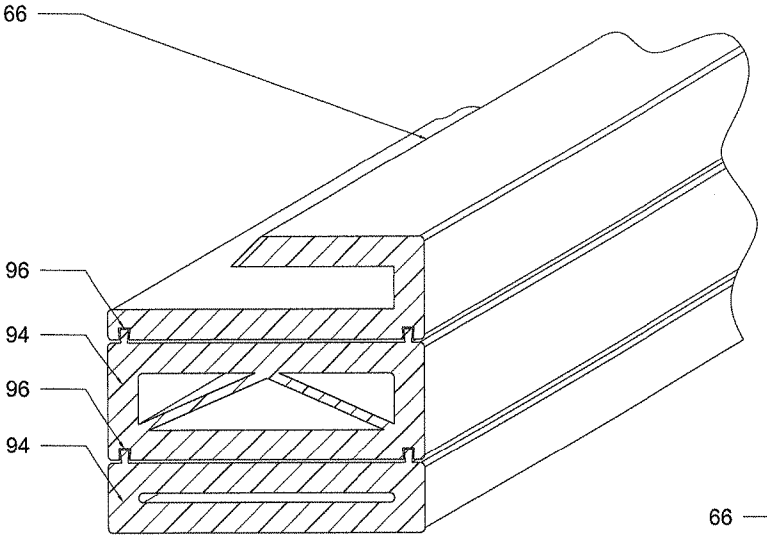
FIG. 6 is a cross-sectional view of a thermal break system for wall panels secured to an existing wall according to a second modification of the first embodiment of the present invention.

Further, as shown in FIG. 6, in order to increase the thermal barrier between the existing wall and the wall panels, for example, to accommodate insulation 64 having different thicknesses, non-thermal conducting spacer members 94 can be connected to J-shaped thermal insulation covers 66 and be provided between J-shaped thermal insulation covers 66 and existing wall 14. Any suitable thermally insulating material can be used, for example, ethylene propylene diene monomer (EPDM), neoprene, polyisoprene, natural rubber, synthetic rubber sold under the trademark VITON, nitrile rubber, silicone, plastics or the like.

FIG. 6 shows two non-thermal conducting spacer members 94 connected to each other and to a J-shaped thermal insulation cover 66 by means of dovetail connections 96 similar to those discussed above with respect to FIG. 5.

Figure 7:
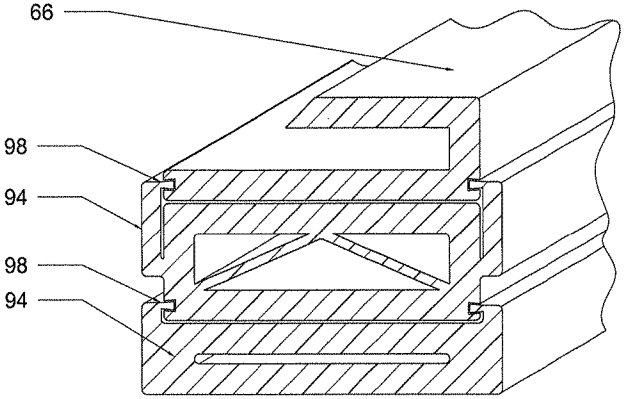
FIG. 7 is a cross-sectional view of a thermal break system for wall panels secured to an existing wall according to a third modification of the first embodiment of the present invention.

FIG. 7 shows two non-thermal conducting spacer members 94 connected to each other and to a J-shaped thermal insulation cover 66 by means of dovetail connections 98 connected at their sides. However, any suitable connection can be used.

Figure 8:
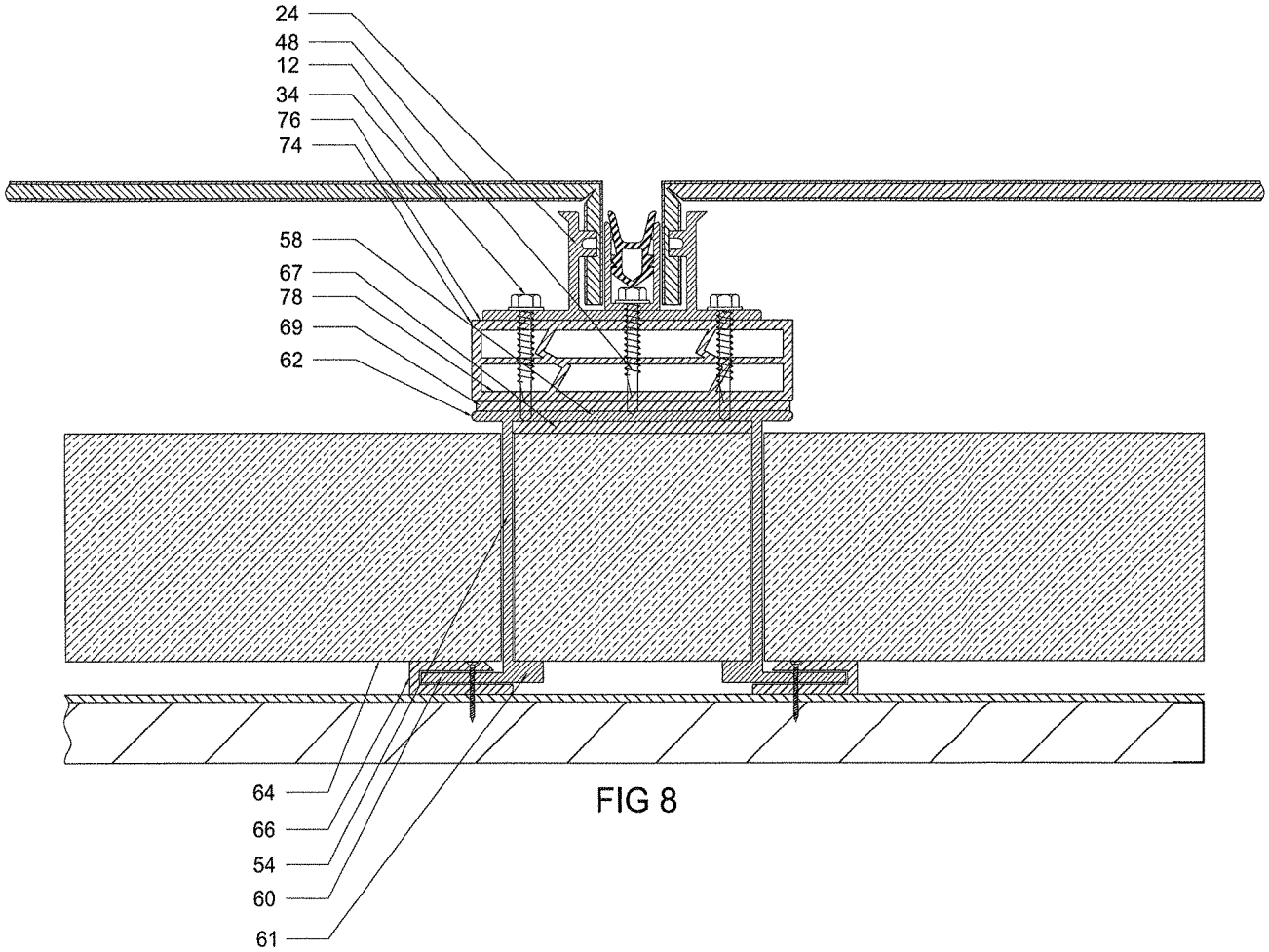
FIG. 8 is a cross-sectional view of a thermal break system for wall panels secured to an existing wall according to a fourth modification of the first embodiment of the present invention.

FIG. 8 shows a modification of the first embodiment of FIGS. 1-4 in which L-shaped hook walls 86 are eliminated, and instead, central planar wall 30 of base section 26 of main fastening extrusion 24 is secured only by screws 34 and 48 to the outer surface of outer wall 76 of thermal break attachment 74, with screws 34 and 48 extending through intermediate wall 84, inner wall 78 and central planar wall 30. Further, an additional planar thermal break wall 69 is positioned between common transverse wall 58 of U-channel furring 52 and inner wall 78 of thermal break attachment 74.

As shown, double sided tape or structural caulking 67 can be provided to hold insulation 64 between walls 54 and 56, to wall 58.

Figure 9:
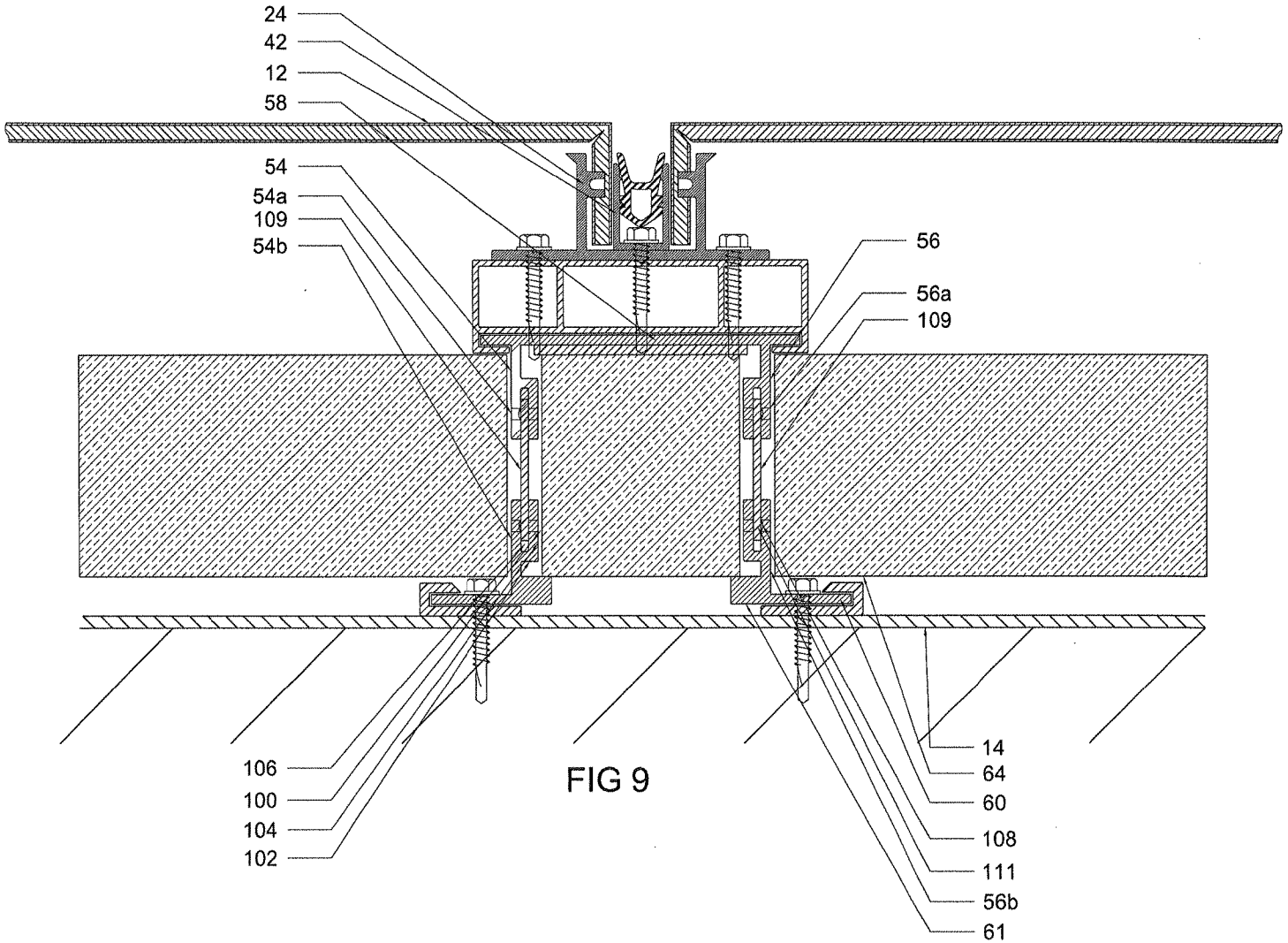
FIG. 9 is a cross-sectional view of a thermal break system for wall panels secured to an existing wall according to a fifth modification of the first embodiment of the present invention.

Instead of using non-thermal conducting spacer members 94 shown in FIGS. 6 and 7 to increase the thermal barrier between the existing wall and the wall panels, wall 54 can be formed in two wall sections 54*a* and 54*b* and wall 56 can be formed in two wall sections 56*a* and 56*b*, as shown in FIG. 9. In such case, wall sections 54*a* and 56*a* are connected with common transverse wall 58, while wall sections 54*b* and 56*b* are connected with foot walls 60 and 61. The free ends of wall sections 54*a* and 54*b*, and the free ends of wall sections 56*a* and 56*b* are spaced apart from each other.

L-shaped wall sections 100 are connected with wall sections 54*a*, 54*b*, 56*a* and 56*b*. Specifically, each L-shaped wall section 100 includes a first transverse stub wall 102 that extends inwardly, and a second wall extension 104 that is connected to the free end of the respective first transverse stub wall 102 and which extends in parallel, spaced apart relation to the respective wall section 54*a*, 54*b*, 56*a* and 56*b*. As a result, a capture space 106 is defined between each wall section 54*a*, 54*b*, 56*a* and 56*b* and its respective second wall extension 104. Further, the surface of each wall section 54*a*, 54*b*, 56*a* and 56*b* that faces its respective second wall extension 104, is formed with at least one depression or recess 108 approximately midway along capture space 106. This may include an elongated recess 108 extending along each wall section 54*a*, 54*b*, 56*a* and 56*b*, or a plurality of spaced apart recesses 108.

A capture wall 109 of a thermal insulation material has one end positioned in the capture space 106 between wall section 54*a* and its second wall extension 104, and its opposite end positioned in the capture space 106 between wall section 54*b* and its second wall extension 104, in order to connect together wall sections 54*a* and 54*b*. In this regard, at least one detent 111 is formed at each end of capture wall 109 for engaging within the at least one recess 108 at each end thereof. Thus, pressing of each end of capture wall 109 into the respective capture space 106 will cause the second wall extension 104 to be biased away from the respective wall section 54*a* or 54*b* until the at least one detent 111 engages in the respective at least one recess 108, whereby the respective second wall extension 104 will resume its original position, and thereby hold the at least one detent 111 engaged in the respective at least one recess 108. The same operation occurs with the opposite side and wall sections 56*a* and 56*b*.

By reason of this arrangement, the height of walls 54 and 56 can be controlled to different heights, by using different height capture walls 109, in order to accommodate insulation 64 of different thicknesses.

Alternatively, recesses 108 and detents 111 can be eliminated, with ends of captured wall 109 held in capture spaces 106 by adhesive, screws or the like.

Although the above first embodiment and modifications thereof have been discussed in relation to U-channel furring 52, the present invention has equal applicability with respect to Z-furring, and all of the above modifications are equally applicable to a Z-furring arrangement.

Figure 10:
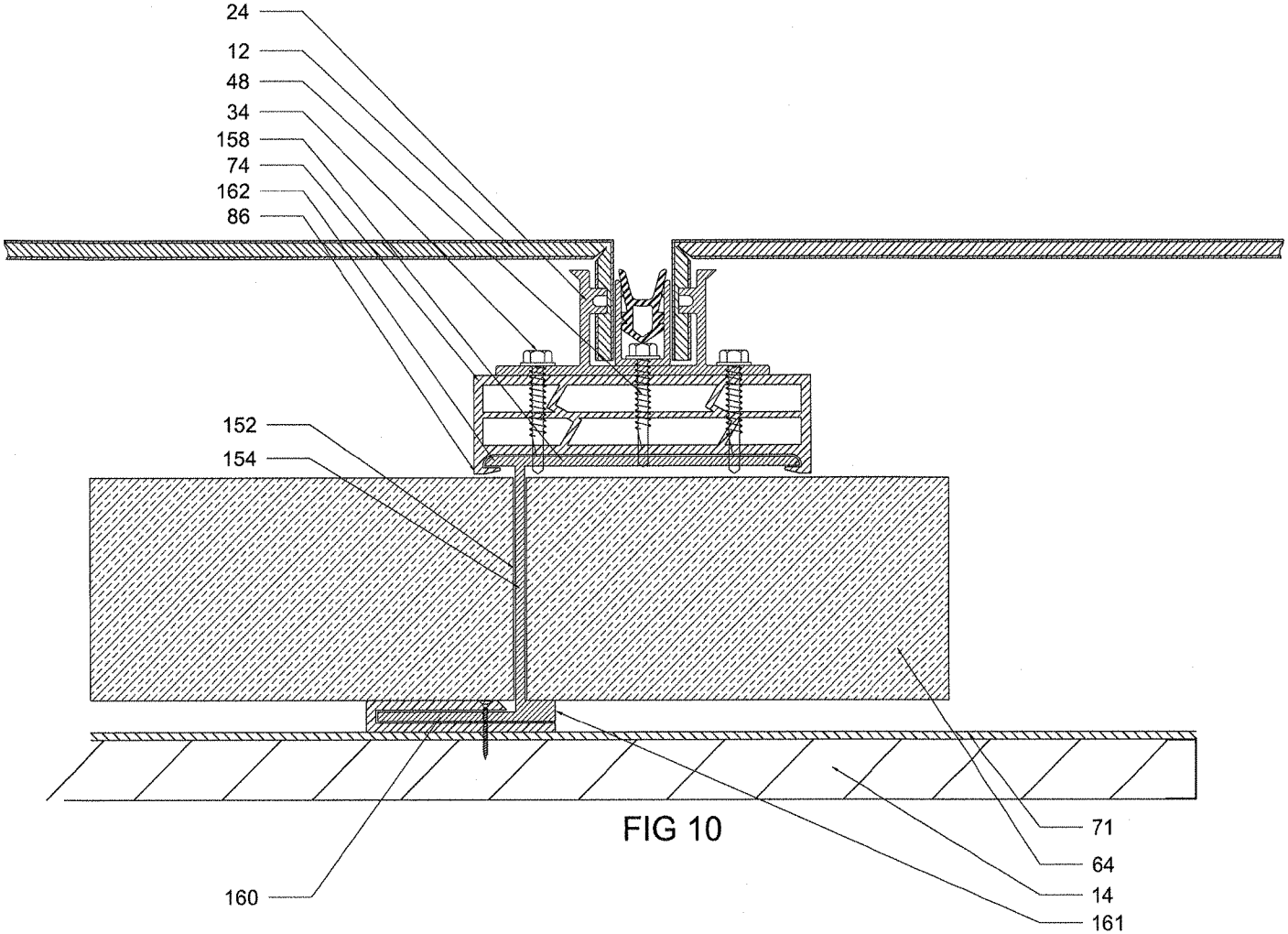
FIG. 10 is a cross-sectional view of a thermal break system for wall panels secured to an existing wall according to a second embodiment of the present invention.

Referring now to FIG. 10, there is a shown a system 110 according to the present invention for mounting wall panels 12 over an existing planar wall 14 through Z-furring 152 with thermal breaks. All of the elements shown in FIG. 1 are identical to those in FIG. 10 and use the same numerals, except that U-channel furring 52 is replaced with Z-furring 152, and therefore, a detailed description of the common elements will be omitted for the sake of brevity.

Z-furring 152 is connected between existing wall 14 and thermal break attachment 74. Specifically, Z-furring 152 includes a single spacing wall 154 that replaces the two parallel, spaced apart walls 54 and 56 of U-channel furring 52, with a transverse connection wall 158 at one end thereof and extending to the right side of wall 154 in FIG. 10, and an extension wall 162 formed as a continuation of transverse wall 158 and extending to the opposite left side of wall 154 in FIG. 10. An outwardly extending transverse foot wall 160 extends from the opposite end of wall 154 to the left side of wall 154 in FIG. 10, and a coplanar, inwardly extending transverse foot wall 161 is also connected to the opposite free end of wall 154, and extends to the right side of wall 154 in FIG. 10. In this manner, insulation 64 positioned in spacing 51 is tightly held between foot wall 160 and extension wall 162 so as to prevent escape thereof, and to keep insulation 64 properly positioned at all times. Further, insulation 64 is tightly held between transverse wall 158 and inwardly extending foot wall 161. This eliminates the need for any additional members to hold the insulation 64 in place, such as screws, adhesives, etc., while also eliminating any extra labor that would result therefrom.

As with U-channel furring 52, transverse wall 158 and extension wall 162 of Z-furring 152 is held by L-shaped hook walls 86 of thermal break attachment 74, as well as by screws 34 and 48.

Figure 11:
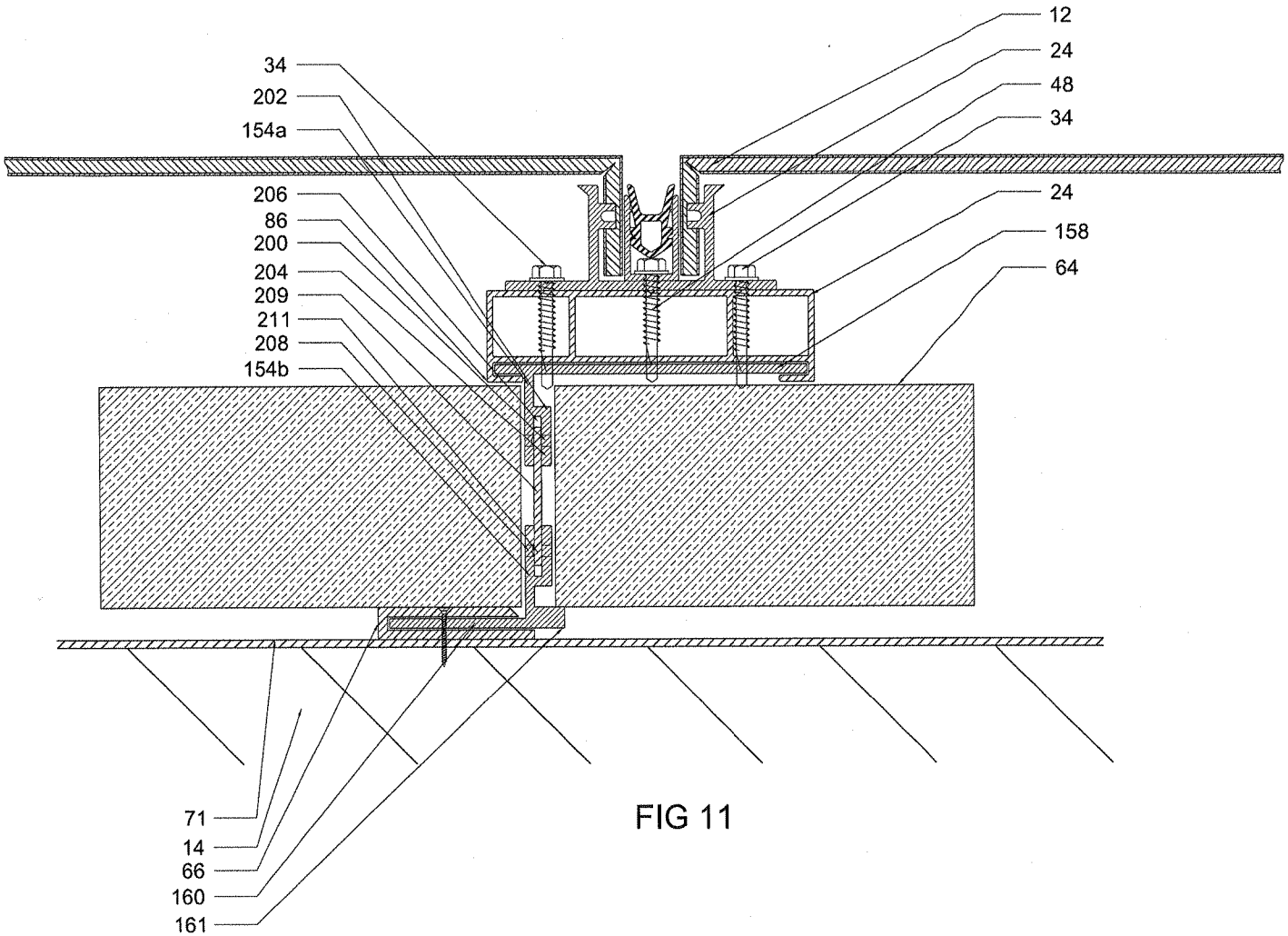
FIG. 11 is a cross-sectional view of a thermal break system for wall panels secured to an existing wall according to a first modification of the second embodiment of the present invention.

As with the system shown in FIG. 9 with U-channel furring 52, a similar arrangement can be provided with Z-furring 152. Thus, referring to FIG. 11, instead of using non-thermal conducting spacer members 94 shown in FIGS. 6 and 7 to increase the thermal barrier between existing wall 14 and wall panels 12, wall 154 can be formed in two wall sections 154*a* and 154*b*. In such case, wall section 154*a* is connected with transverse wall 158, while wall section 154*b* is connected with foot walls 160 and 161. The free ends of wall sections 154*a* and 154*b* are spaced apart from each other.

L-shaped wall sections 200 are connected with wall sections 154*a* and 154*b*. Specifically, each L-shaped wall section 200 includes a first transverse stub wall 202 that extends inwardly, and a second wall extension 204 that is connected to the free end of the respective first transverse stub wall 202 and which extends in parallel, spaced apart relation to the respective wall section 154*a* and 154*b*. As a result, a capture space 206 is defined between each wall section 154*a* and 154*b* and its respective second wall extension 204. Further, the surface of each wall section 154*a* and 154*b* that faces its respective second wall extension 204, is formed with at least one depression or recess 208 approximately midway along capture space 206. This may include an elongated recess 208 extending along each wall section 154*a* and 154*b*, or a plurality of spaced apart recesses 208.

A capture wall 209 of a thermal insulation material has one end positioned in the capture space 206 between wall section 154*a* and its second wall extension 204, and its opposite end positioned in the capture space 206 between wall section 154*b* and its second wall extension 204, in order to connect together wall sections 154*a* and 154*b*. In this regard, at least one detent 211 is formed at each end of capture wall 209 for engaging within the at least one recess 208 at each end thereof. Thus, pressing of each end of capture wall 209 into the respective capture space 206 will cause the second wall extension 204 to be biased away from the respective wall section 154*a* or 154*b* until the at least one detent 211 engages in the respective at least one recess 208, whereby the respective second wall extension 204 will resume its original position, and thereby hold the at least one detent 211 engaged in the respective at least one recess 208.

By reason of this arrangement, the height of wall 154 can be controlled to different heights by using different height capture walls 209, in order to accommodate insulation 64 of different thicknesses.

Figure 12:
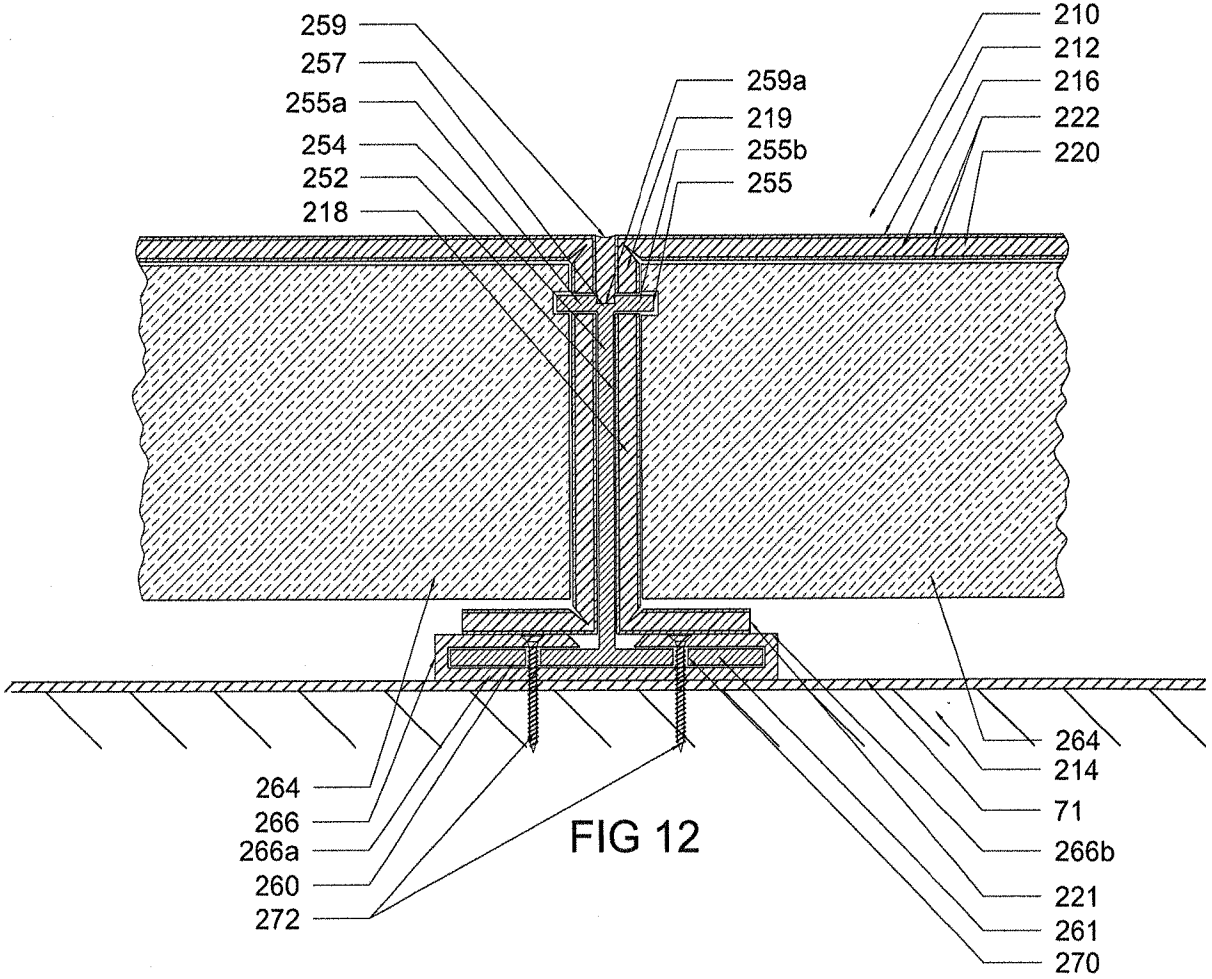
FIG. 12 is a cross-sectional view of a thermal break system for wall panels secured to an existing wall according to a third embodiment of the present invention.

Referring now to FIG. 12, there is a shown a system 210 according to the present invention for mounting wall panels 212 over an existing planar wall 214 through a T-furring 252 with thermal breaks.

Each wall panel 212 preferably includes a rectangular shaped, planar main panel section 216 and L-shaped bent end sections 218 at each edge. As a result, planar panel section 212, together with L-shaped bend 218, forms a U-shaped hook structure at each edge. Specifically, each L-shaped bent end section 218 includes a first right angle panel section 219 at each free side edge of main panel section 216 which extends at a right angle away from main panel section 216, and a second right angle panel section 221 which extends inwardly at a right angle from the free side edge of first right angle panel section 219 such that each second right angle panel section 221 is positioned behind main panel section 216 in spaced, parallel relation thereto. However, second right angle panel section 221 can be eliminated. Main panel section 216, however, need not be planar, and in fact, can have different shapes, such as a wave shape, etc. to provide different aesthetic appearances. Preferably, there are four bent end sections 218 at each edge of main panel section 216. However, the invention is not limited thereby and wall panels 212 can be formed with two, three or more bent end sections 218. Wall panels 212 are formed preferably by, but not limited to, a polyethylene core 220 with an aluminum wall 222 covering opposite sides thereof, as shown in FIG. 1.

As shown in FIG. 12, insulation 264 is captured and held between main panel section 216 and second right angle panel sections 221.

Further, as will be described hereafter, each second right angle panel section 221 includes through openings or slots 224 near the end that connects with main panel section 216.

In order to provide a spacing 251 between wall panels 212 and existing wall 214, for example, for ventilation, to provide for water run-off, to provide insulation therein, and to provide a thermal barrier, a T-furring 252 is connected between existing wall 214 and wall panels 212.

Specifically, T-furring 252 includes a spacing wall 254 that is positioned between, and in abutting relation with, first right angle panel sections 219 of adjacent wall panels 212, and coplanar foot walls 260 and 261 extending from opposite sides of the end of wall 254 positioned adjacent existing wall 214. A transverse wall 255 is connected centrally at the upper end of wall 254 and extends to both sides of wall 254 so as to form left and right stub walls 255*a* and 255*b*, which are positioned within openings or slots 224 in order to connect T-furring 252 to second right angle panel sections 221 of wall panels 212. In such case, it will be appreciated that the upper surface of transverse wall 255 is spaced below the outer exposed surfaces of planar main panel sections 216 of wall panels 212. A dovetail opening or slot 257 is formed centrally in the upper surface of transverse wall 255 in order to receive a thermal break wall member 259 above transverse wall 255 and between second right angle panel sections 221 of adjacent wall panels 212. In this regard, the lower end of thermal break wall member 259 has a dovetail projection 259*a* that fits within dovetail opening or slot 257.

A thermal insulation cover 266 is positioned around foot walls 260 and 261, and is made of a thermally insulating material so that foot walls 260 and 261 are not in direct contact with existing wall 214 of the building. Any suitable thermally insulating material can be used, for example, ethylene propylene diene monomer (EPDM), neoprene, polyisoprene, natural rubber, synthetic rubber sold under the trademark VITON, nitrile rubber, silicone, plastics or the like. Thermal insulation cover 266 includes a planar wall 266*a* positioned between foot walls 260 and 261 and existing wall 214, and L-shaped wrapping walls 266*b* that wrap around foot walls 260 and 261. Screws 272 extend through the upper covering ends of wrapping walls 266*b*, through foot walls 260 and 261 and through planar wall 266*a* into existing wall 214 to secure T-furring 252 to existing wall 214, and thereby secure wall panels 212 to existing wall. It will be appreciated, in the same manner as shown in FIG. 4, the diameter of screw holes 270 in foot walls 260 and 261 is much greater than the diameter of screws 272 so that screws 272 are not in contact with foot walls 260 and 261, and therefore, do not provide any thermal conduction to existing wall 214.

With this arrangement, there is a space between the lower surfaces of insulation 264 and existing wall 214 which allows for water and air circulation.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A thermal break system for securing wall panels to an existing wall, in order to mount the wall panels in covering relation to the existing wall, said thermal break system comprising:

a furring member connected between the existing wall and the wall panels, the furring member including:

at least one foot wall adapted to be connected to the existing wall, at least one spacing wall having one end connected to the at least one foot wall and extending in a direction transverse to the at least one foot wall and the existing wall, and a connection wall connected to an opposite end of the at least one spacing wall and extending in a direction transverse to the at least one spacing wall for connection one of:

directly to adjacent wall panels, and indirectly to adjacent wall panels through at least one intermediary member, wherein the at least one spacing wall includes a first wall section connected with the at least one foot wall and a second wall section connected with the connection wall, with free ends of the first and second wall sections being spaced apart from each other;

a capture wall connected between the free ends of the first and second wall sections to increase a height of the at least one spacing wall; and a capture arrangement for securing opposite ends of the capture wall to the free ends of the first and second wall sections, the capture arrangement including:

an L-shaped wall section secured to the first and second wall sections so as to create a capture space with the first and second wall sections for receiving respective ends of the capture wall, and a securing arrangement for securing each end of the capture wall in a respective said capture space.

2. A thermal break system according to claim 1, wherein the securing arrangement includes:

a recess in one of:

each end of the capture wall and the first and second wall sections in the capture space; and a detent in the other one of:

each end of the capture wall and the first and second wall sections in the capture space.

3. A thermal break system according to claim 1, wherein the furring member has one of:

a U-shape, and a Z-shape.

4. A thermal break system for securing wall panels to an existing wall, in order to mount the wall panels in covering relation to the existing wall, said thermal break system comprising:

a furring member connected between the existing wall and the wall panels, the furring member including:

first and second foot walls, at least one of the foot walls adapted to be connected to the existing wall, at least one spacing wall having one end connected to the first and second foot walls and extending in a direction transverse to the first and second foot walls and the existing wall, with the first foot wall extending to one side of the at least one spacing wall and the second foot wall extending to an opposite side of the at least one spacing wall, and a connection wall connected to an opposite end of the at least one spacing wall and extending in a direction transverse to the at least one spacing wall for connection one of:

directly to adjacent wall panels, and indirectly to adjacent wall panels through at least one intermediary member, wherein the connection wall includes a first section extending to the one side of the at least one at least one spacing wall and a second section extending to the opposite side of the at least one spacing wall, so as to hold one end of insulation between the first foot wall and the first section of the connection wall and to hold one end of insulation between the second foot wall and the second section of the connection wall;

at least one thermal insulation cover positioned between the at least one foot wall and the existing wall;

a thermal break attachment connected to the connection wall, the thermal break attachment including spaced apart walls to provide a further thermal break between the existing wall and the wall panels;

a fastening extrusion secured to the thermal break attachment for securing the wall panels to the thermal break attachment;

wherein the at least one spacing wall includes a first wall section connected with the at least one foot wall and a second wall section connected with the connection wall, with free ends of the first and second wall sections being spaced apart from each other; and a capture wall connected between the free ends of the first and second wall sections to increase a height of the at least one spacing wall.

* * * * *